United States Patent [19]

Skahill

[11] 4,131,052

[45] Dec. 26, 1978

[54] DRUM CAM WITH ANTI HANG-FIRE FEATURE

[75] Inventor: Fred J. Skahill, Davenport, Iowa

[73] Assignee: The United States of America as represented by the Secretary of the Army, Washington, D.C.

[21] Appl. No.: 812,878

[22] Filed: Jul. 5, 1977

[51] Int. Cl.[2] ..... F41D 7/02

[52] U.S. Cl. ..... 89/11

[58] Field of Search ..... 89/9, 11

[56] References Cited

U.S. PATENT DOCUMENTS 4,062,266 12/1977 Elmore et al. ..... 89/11

*Primary Examiner*—Stephen C. Bentley

*Attorney, Agent, or Firm*—Nathan Edelberg; Robert O. Richardson

[57] ABSTRACT

A drum cam for reciprocating the operating group of an externally powered weapon, wherein hang-fire is prevented by transferring the cam follower to a separate cam path when the group is in in-battery position, and the follower dwells until a chambered round has fired before permitting the operating group to recoil.

6 Claims, 6 Drawing Figures

DRUM CAM WITH ANTI HANG-FIRE FEATURE

GOVERNMENT RIGHTS

The invention described herein may be manufactured and/or used by or for the Government for governmental purposes without the payment of any royalty thereon.

BACKGROUND OF THE INVENTION

Since the development of the Gatling gun, externally powered weapons have been proving their worth to the armed forces. Modern day weapons of this type are typically powered by electric motors. The chief advantage of externally powered weapons over other automatic weapons is the ability to easily change the rate of fire of the weapon. This may be accomplished by simply changing the speed of the electric drive motor. Such weapons also achieve higher rates of fire than gas operated automatic weapons.

Externally powered weapons do not utilize the energy developed by the detonated cartridges to activate the weapon system. For example, in U.S. Pat. No. 3,548,709 issuing Dec. 22, 1970 for Firing Mechanism for Automatic Grenade Launcher, a rotating drum with helical cam track reciprocates the barrel to open and close the breech. Such weapons will continue to cycle even though a chambered cartridge has not fired. This eliminates the possibility of a weapon stoppage due to a misfire, but may lead to a very hazardous situation. Occasionally a round of ammunition will not fire within the prescribed limits of time after the firing pin falls. The extraction and ejection sequence progresses just as if the round had fired. The extracted round may then detonate, presenting a hazardous situation to the weapon operator and any other personnel in the vicinity. This condition is called a hang-fire.

SUMMARY OF THE INVENTION

An externally powered weapon, in accordance with the present invention, precludes the possibility of hang-fires. This is accomplished by delaying the extraction and ejection sequence until the round in the chamber has fired.

Externally powered weapons normally utilize a cylindrical drum cam to convert rotary motion to reciprocal longitudinal motion required for the weapon's operating group. A follower on the operating group engages a cam path on the drum cam. Rotary motion of the drum cam causes the operating group to reciprocate as required between the in-battery and recoil positions.

The drum cam of the present invention is designed so that the recoil cycle is not initiated until the chambered round is fired. As the operating group reaches the in-battery position the cam follower is transferred to a separate cam path. The follower then dwells until the chambered round fires. The detonated round imparts rearward movement to the barrel and operating group. This rearward movement causes the cam follower to engage the original cam path on the drum cam. The operating group may then move toward the recoil position as the drum cam continues to rotate.

DETAILED DESCRIPTION OF ILLUSTRATIVE EMBODIMENTS

Figure 1:
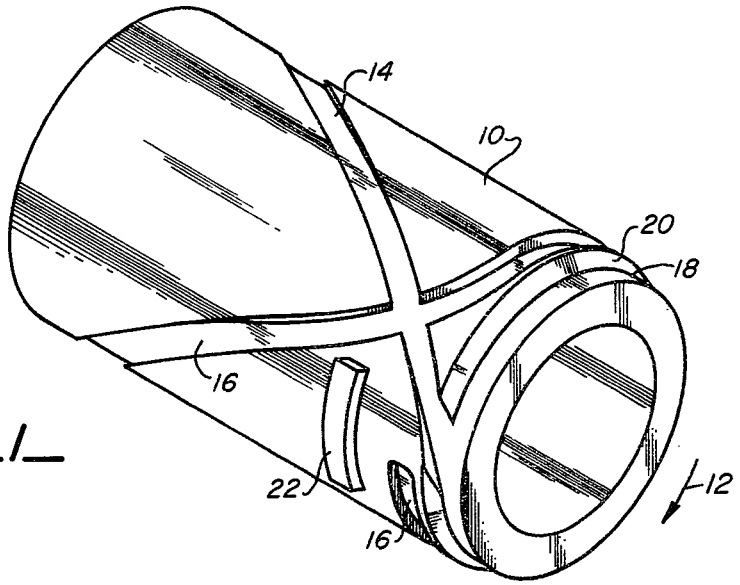
FIG. 1 is a perspective view of the drum cam.

Reference is now made to FIG. 1 which shows an operating drum 10 meant to be fastened within a gun assembly and rotatable in the direction of arrow 12. A cam follower, shown in other views, is moved longitudinally as the drum rotates. The cam follower rides forwardly when in groove 14 and rearwardly when in groove 16. Connected to this cam follower is the operating group, also shown in other views, which moves longitudinally in response to the rotation of the drum. In prior art applications, the grooves 14, 16 form an endless FIG. 8 configuration and when the cam follower is in groove 14 it is moved forwardly to the in-battery position. When the cam follower is in the groove 16, it is moved rearwardly to the recoil position. In the present invention such is not the case. Groove 14 terminates at its forward edge in a continuous circumferential groove 18 that neither moves the cam follower forwardly nor retracts it when riding therein. The rearward wall of groove 18 is tapered to form a ramp 20 which will permit the cam follower in the operating group to move rearwardly to reengage groove 16 and thus provide the recoil function to the operating group.

Located on the outer surface of drum 10 is a firing pin retaining projection 22 which retains the firing pin in rearward position while the operating group moves forwardly. This places the firing pin in a position for the firing of the weapon.

Figure 2:
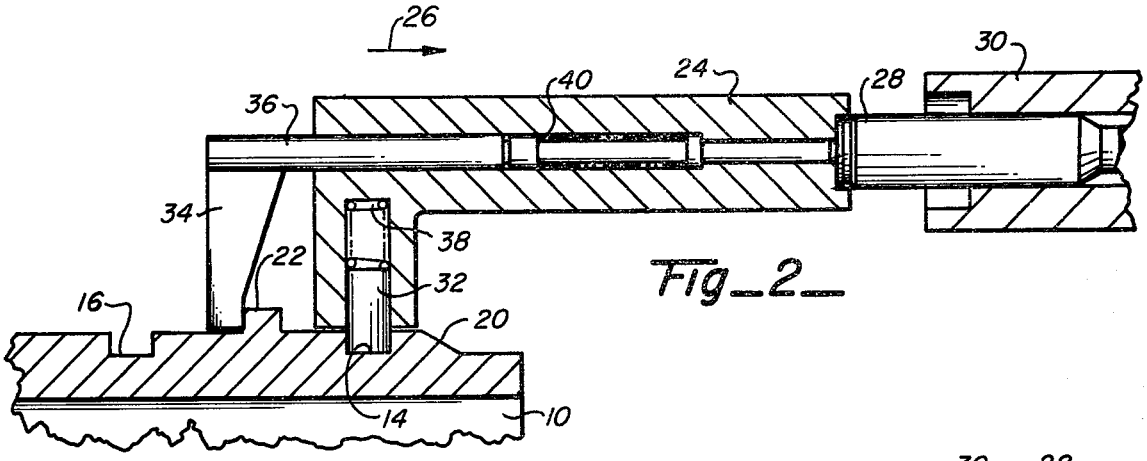
FIG. 2 is a sectional view in elevation showing the position of the various parts when a cartridge is being chambered by forward movement of the operating group while the firing pin is retained rearwardly.

A more complete understanding of the operation of this drum cam in FIG. 1 will become apparent as the sequence of steps in the operation of the weapon is explained with reference to FIGS. 2 through 6. In FIG. 2 the operating group 24 is moving forwardly in the direction of arrow 26 to inject a cartridge 28 into barrel 30. To do this, a cam follower 32 is provided which is attached to the operating group 24. This cam follower rides forwardly in groove 14 as drum 10 is rotated, in the manner previously explained. While this is occurring, an extension 34 of firing pin 36 engages a firing pin retaining projection 22 on drum 10 to prevent the forward movement of firing pin 36. Since the operating group 24 moves forwardly and firing pin 36 does not, this in effect "cocks" the weapon, making it ready for firing.

It should be observed that the follower 32 is resiliently housed in the operating group 24 and urged into the groove 14 by means of a spring 38.

Figure 3:
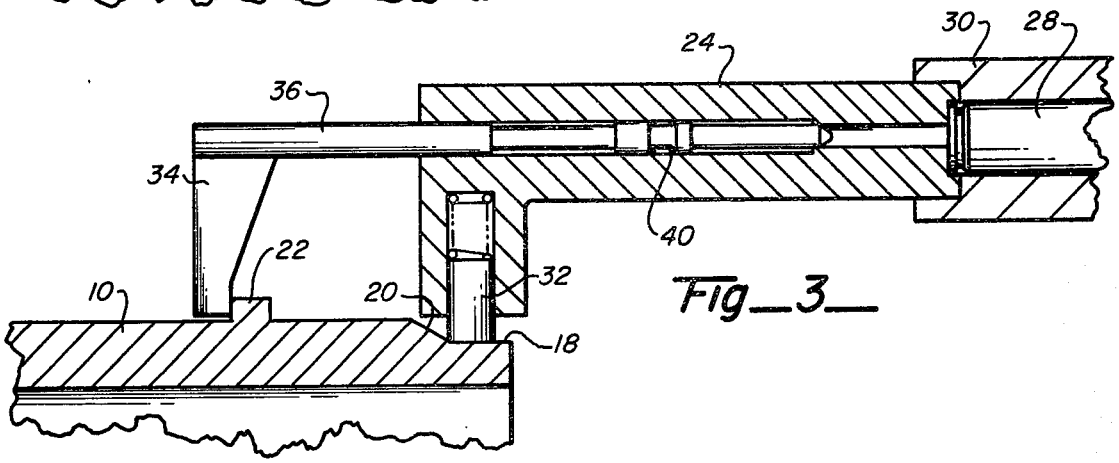
FIG. 3 is a view similar to FIG. 2 wherein the operating group is in in-battery position and the cam follower has moved into the separate cam path.

In FIG. 3 there is shown the next sequence in the operation. Here the operating group 24 is in the in-battery position with the cartridge 28 chambered in barrel 30 and the weapon is ready for firing. It should be noted that the follower 32 is in the circumferential groove 18 so that the continued rotation of the drum 10 does not cause any longitudinal movement of the operating group 24. In this view, the extension 34 of firing pin 36 is still engaging the firing pin retaining projection 22. Further rotation of drum 10 removes the projection 22 from the longitudinal path of movement of the extension 34 and permits forward movement of the firing pin 36 under the urging of firing pin spring 40.

Figure 4:
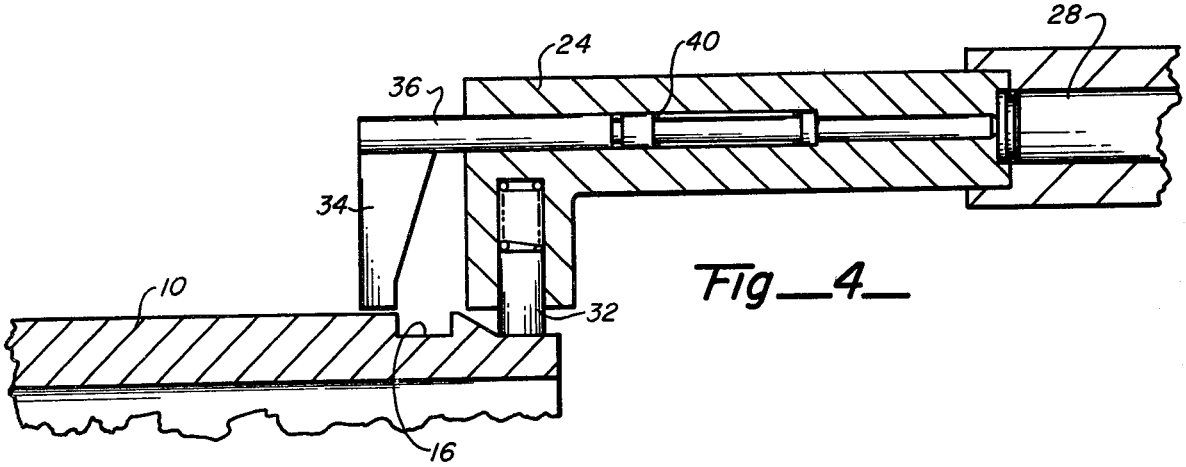
FIG. 4 is a view similar to FIG. 3 wherein the firing pin has been released to fire the cartridge.

In FIG. 4 the firing pin 36 has just moved forward, striking the cartridge 28 and causing it to fire.

Figure 5:
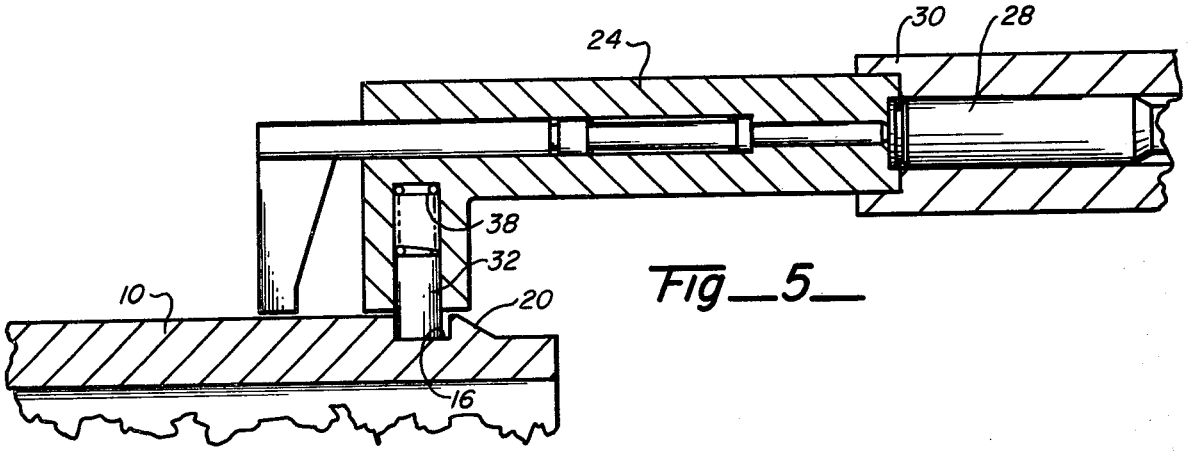
FIG. 5 is a view similar to FIG. 4 wherein the barrel and operating group has recoiled from the firing, causing the cam follower to reengage the initial cam path.

In FIG. 5 the cartridge 28 has been fired, and the barrel 30 and operating group 24 have been moved somewhat rearwardly due to the reaction forces from the firing of the cartridge. As can be seen in comparing FIGS. 4 and 5, the cam follower 32 has been depressed as it moves up ramp 20 and, under the urging of spring 38, returned to path 16 on the drum 10. Continued rotation of the drum 10, in the direction of arrow 12 in FIG. 1, will cause the operating group to move rearwardly to its recoil position.

Figure 6:
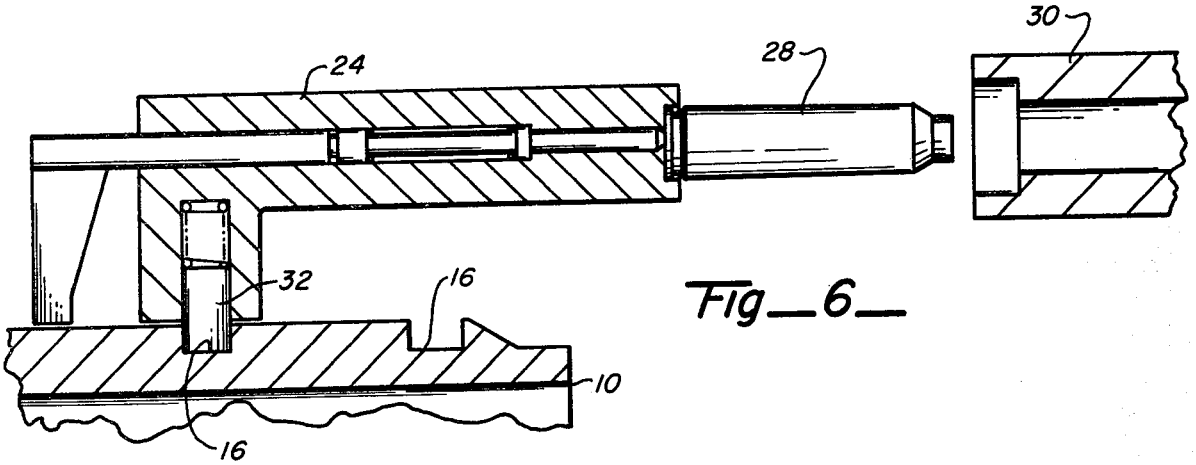
FIG. 6 is a view similar to FIG. 5 wherein the drum has continued its rotation to fully move the operating group to recoil position and to extract the fired cartridge.

In FIG. 6 the cycle has been completed, with the extraction of cartridge casing 28 from barrel 30 and the return of the operating group 24 to the rearward recoil position due to the engagement of follower 32 with groove 16 in the rotating drum 10.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A drum cam with anti hang-fire feature, in combination with the operating group of an externally powered automatic weapon, said cam comprising:

a drum having a first diagonal groove for moving said operating group forward to in-battery position when a cam follower on said group is positioned in said first groove and said drum is rotating, said drum having a second diagonal groove for moving said operating group rearward to recoil position when a cam follower on said group is positioned in said second groove and said drum is rotating, and means responsive to the recoil of said operating group after firing of a cartridge for moving said cam follower into said second groove.

2. A drum cam in combination with the operating group of an externally powered weapon as set forth in claim 1, said means comprising a depressible cam follower on said operating group, said drum having a circumferential groove, said first diagonal groove being engageable with and terminating in said circumferential groove, said cam follower being responsive to said circumferential groove when said operating group is in forward in-battery position, said circumferential groove having an inclined rear wall whereby recoil from a fired cartridge moves said operating group sufficienty rearwardly to move said cam follower up said ramp and rearwardly into engagement with said second diagonal groove.

3. A drum cam in combination with the operating group of an externally powered weapon as set forth in claim 2, said depressible cam follower having a spring therebehind to resiliently urge said follower into said grooves and permit depression thereof as said follower is urged up said ramp upon recoil of said operating group when said cartridge is fired.

4. A drum cam in combination with the operating group of an externally powered weapon as set forth in claim 1 wherein said first diagonal groove spirals forwardly in a direction opposite to the direction of rotation of said drum.

5. A drum cam in combination with the operating group of an externally powered weapon as in claim 1 wherein said second diagonal groove spirals forwardly in the same direction as the direction of rotation of said drum.

6. A drum cam in combination with the operating group of an externally powered weapon as in claim 1 wherein in operation the operating group moves forwardly, dwells in in-battery position until a cartridge firing recoils it rearwardly, and said group then moves rearwardly to recoil position while said drum continuously rotates in one direction.

* * * * *